313-422 SR
1/19/88 OR 4,720,655

United States Patent [19]
Hinotani et al.

[11] Patent Number: 4,720,655
[45] Date of Patent: Jan. 19, 1988

[54] FLAT COLOR CATHODE-RAY TUBE WITH PHOSPHOR INDEX STRIPES

[75] Inventors: Katsuhiro Hinotani, Shijyonawate; Hajime Hayama, Nara; Shunichi Kishimoto, Kaizuka; Takashi Miwa, Higashiosaka; Yasuo Funazo, Toyonaka; Kazuhiro Kouno, Hirakata, all of Japan

[73] Assignee: Sanyo Electric Co., Ltd., Osaka, Japan

[21] Appl. No.: 776,266

[22] Filed: Sep. 16, 1985

[30] Foreign Application Priority Data

Sep. 17, 1984 [JP] Japan ..... 59-140517

[51] Int. Cl.[4] ..... H01J 29/32; H01J 29/28
[52] U.S. Cl. ..... 313/422; 313/466; 313/471
[58] Field of Search ..... 313/471, 466, 422

[56] References Cited

U.S. PATENT DOCUMENTS

| | | | |
|---|---|---|---|
| 3,005,125 | 10/1961 | Evans et al. | 313/471 |
| 3,154,715 | 10/1964 | Jackson et al. | 313/471 X |
| 4,180,760 | 1/1978 | Chang | 313/422 |
| 4,551,652 | 11/1985 | Compen et al. | 313/466 |

FOREIGN PATENT DOCUMENTS

| | | | |
|---|---|---|---|
| 1292966 | 10/1968 | European Pat. Off. . | |
| 57-27539 | 2/1982 | Japan . | |
| 0087741 | 5/1984 | Japan | 313/422 |
| 60-220538 | 11/1985 | Japan . | |
| 2133211 | 12/1983 | United Kingdom . | |

OTHER PUBLICATIONS

WO-84/03796, 9/27/84.

*Primary Examiner*—Palmer C. DeMeo
*Attorney, Agent, or Firm*—Armstrong, Nikaido, Marmelstein & Kubovcik

[57] ABSTRACT

A flat color CRT having a phosphor screen comprises red, green and, blue primary phosphor color stripes arranged at a spacing, and phosphor index stripes arranged in some of the spaces between the phosphor color stripes in a definite relation thereto. A black non-luminescent substance is provided between the phosphor index stripes and positioned at least in the spaces between the phosphor color stripes, and a metallic layer of sufficient thickness formed on the inner side of a tube panel and positioned in a corresponding relationship to the phosphor color stripes.

6 Claims, 9 Drawing Figures

FLAT COLOR CATHODE-RAY TUBE WITH PHOSPHOR INDEX STRIPES

TECHNICAL FIELD

The present invention relates to a flat, color cathode-ray tube (hereinafter referred to as "CRT") having a beam-indexing system incorporated therein.

BACKGROUND OF THE INVENTION

As is well known, beam-indexing color CRTs have a phosphor screen comprising a multiplicity of phosphor index stripes arranged on the inner surface of a panel and three primary phosphor color stripes repeatedly arranged on the panel inner surface in a definite relation with the phosphor index stripes. When the phosphor screen is scanned by a single electron beam, an index light signal is obtained, which is utilized for the electron beam to excite the desired phosphor color with a specified amount of electron beam for the reproduction of color images.

There are two types of flat, color CRTs incorporating such a beam-indexing system. FIG. 5 shows the structure of one of these types. With reference to FIG. 5, a flat glass tube 1 comprises a neck 3 accommodating an electron gun 2, a funnel 4 and a panel 6 provided with a phosphor screen 5 (shown in FIG. 6) on its inner surface. The phosphor screen 5 is inclined with respect to the central axis of the electron gun 2 (to the direction of propagation of an electron beam 7 when the beam is not deflected).

The phosphor screen 5 comprises red, green, and blue, i.e., three primary phosphor color stripes 8 repeatedly arranged on the inner surface of the panel 6. A metallic layer 9 of aluminum is formed over the resulting pannel inner surface. Phosphor index stripes 10 are provided on the metallic layer 9 in a definite relation with the primary phosphor color stripes 8 (FIG. 6).

With such a flat CRT, the single electron beam 7 emitted by the electron gun 2 is deflected by a deflection yoke 14 and scans the phosphor screen 5 to produce index light, which strikes a light collector plate 11 disposed on the rear side of the funnel 4. The index light collected by the plate 11 is converted to a wavelength which matches the sensitivity of a photodetector. The light is led from the plate 11 to a photodiode 12 provided at one end of the light collector plate 11. The photodiode 12 produces an electric signal upon conversion. Published Unexamined Japanese Patent Application No. SHO 57-65651 discloses a light collector plate which is usable as the plate 11.

On the other hand, the electron beam 7 passes through the metallic layer 9 and excites a phosphor color stripe 8, whereupon the stripe luminesces. The luminescence is observed through the panel 6.

However, the flat, color CRT of the above construction has a drawback in that the color image reproduced is insufficient in luminance because the electron beam 7 excites the phosphor color stripe 8 through the metallic layer 9. Since the phosphor screen 5 is arranged as inclined with respect to the axis of the electron gun 2, the beam 7 is incident on the screen 5 obliquely. This results in the electron beam passing through the metallic layer 9 traveling a longer distance. An increased proportion of the electron beam energy therefore attenuates within the metallic layer 9 to further reduce the luminance of luminescence of the phosphor color stripe 8.

Published Unexamined Japanese Patent Application No. SHO 57-27541 discloses a flat, color CRT of the other type which is adapted to overcome the above drawback. FIGS. 7 and 8 schematically show the construction of the CRT. With reference to FIG. 7, a phosphor screen 50 comprises phosphor index stripes 10 provided on the inner surface of a panel 6, a metallic layer 9 of uniform thickness formed over the panel inner surface to cover the stripes 10, and primary phosphor color triplet stripes 8 provided on the metallic layer 9. In this case also, the phosphor index stripes 10 are of course arranged in a definite relation with the arrangement of phosphor color stripes 8.

With the flat, color CRT of this structure, an electron beam 7 directly excites the phosphor color stripe 8 for luminescence, and the luminescence is reflected from the metallic layer 9 toward the interior vacuum space of the flat glass tube 1, so that a bright color image can be observed through a window formed in a funnel 4.

Nevertheless, the phosphor screen 50 has a drawback. With reference to FIG. 8 showing the screen 50 in greater detail, the electron beam 7 passes through the metallic layer 9 and excites the phosphor index stripe 10, which therefore produces weak luminescence. Consequently, the index light incident on a light collector plate 11 through a panel 6 is low in intensity.

In the case of beam-indexing color TV receivers, it is necessary to obtain an index signal at all times in order to detect the position of the electron beam as is well known, so that even for the reproduction of a black image, a beam current of not lower than a specified level is passed. Accordingly, it is desirable that a smaller amount of electron beam is needed for the index signal for reproducing of a black level to give improved contrast to the image. However, because the metallic layer attenuates the energy of the electron beam as mentioned above, it is required for reproducing a black level, the amount of electron beam be larger in the CRT of the second type than where the electron beam directly excites the phosphor index stripe. This invariably results in lower contrast.

To overcome this drawback, we, the applicants, have already proposed a flat CRT of the following construction in Japanese Patent Application No. SHO 59-77772 (filed on Apr. 17, 1984 and published Nov. 5, 1985.)

FIG. 9 shows a sectional view of the phosphor screen of the proposed CRT. Three primary phosphor color stripes R (red), G (green) and B (blue), are arranged at a predetermined spacing, are formed on an aluminum metallic layer 16 on the inner surface of a panel 6. On the other hand, phosphor index stripes 17 are provided on the inner surface of the panel 6 and positioned in spaces 18 between the phosphor color stripes R, G, B, as arranged in a definite relation with these color stripes. No metallic layer 16 is formed on the phosphor index stripes 17. The metallic layer 16 in contact with the phosphor color stripes R, G, B has a thickness $L_1$ which is sufficiently large so that when the electron beam excites the phosphor color stripes R, G, B, the resulting luminescence is totally reflected from the metallic layer 16 without passing therethrough.

With the construction described above, the luminescence of the primary phosphor color stripes R, G, B by the electron beam 7 is totally reflected at the metallic layer 16 and released toward an observation window 13, enabling the viewer to observe a bright color image through the window 13. Moreover, with no metallic layer 16 formed over the phosphor index stripes 17, the electron beam excites the phosphor index stripe 17 without attenuation. This results in an index light of high intensity available at the light collector plate through the panel 6. When necessary, an electrically conductive transparent film 19 can be provided for the observation window 13 of the funnel 4. The film 19 is maintained at the same potential (anode potential) as the metallic layer 16.

For the flat CRT to produce images with still improved contrast, a nonluminescent substance such as carbon must be interposed between the primary phosphor color stripes. The nonluminescent substance commercially available generally comprises a mixture of carbon and an aqueous solution of ammonia or like alkali material so as to render the carbon effectively separable. However, due to the presence of the aqueous solution, the nonluminescent substance is not compatible with the metallic film of aluminum. Therefore, it is extremely difficult to form carbon stripes on the metallic layer 16 using the nonluminescent substance.

SUMMARY OF THE INVENTION

An object of the present invention is to provide a flat, color CRT incorporating a beam-indexing system and capable of reproducing bright color images having a satisfactory contrast ratio.

Another object of the present invention is to facilitate formation of a carbon layer which is indispensable to the improvement of contrast.

The present invention provides a flat, color CRT having a phosphor screen which comprises red, green and blue primary phosphor color stripes arranged at a spacing, phosphor index stripes arranged in some of the spaces between the phosphor color stripes in a definite relation thereto, a black nonluminescent substance provided between the phosphor index stripes and positioned at least between the phosphor color stripes, and a metallic layer of sufficient thickness formed on the nonluminescent substance and positioned in corresponding relation to the phosphor color stripes.

DETAILED DESCRIPTION OF THE INVENTION

Figure 1:
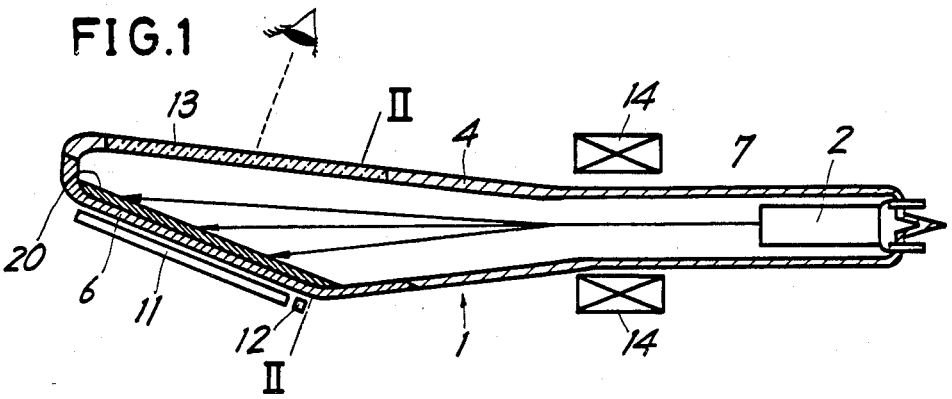
FIG. 1 is a view in longitudinal section showing a flat, color CRT according to the present invention.
Figure 6:
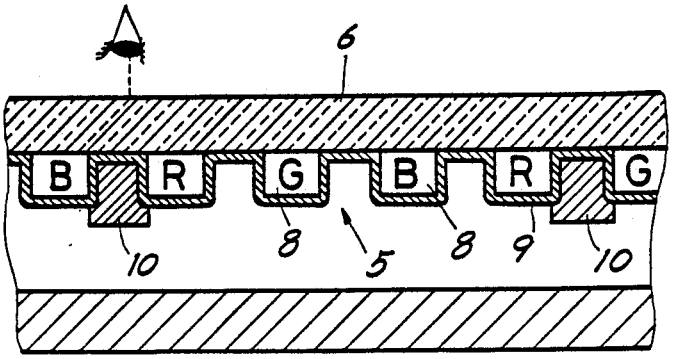
FIG. 6 PRIOR ART
FIG. 6 is a view in cross section taken along the line VI—VI in FIG. 5.
Figure 7:
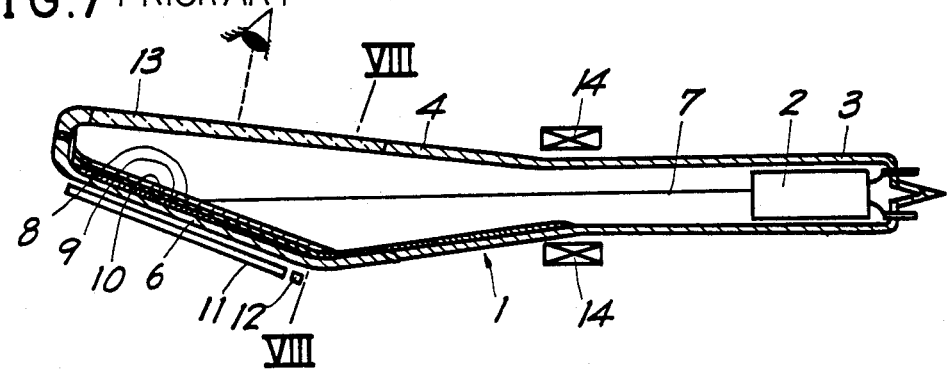
FIG. 7 PRIOR ART
FIG. 7 is a view in longitudinal section showing another conventional flat, color CRT.
Figure 8:
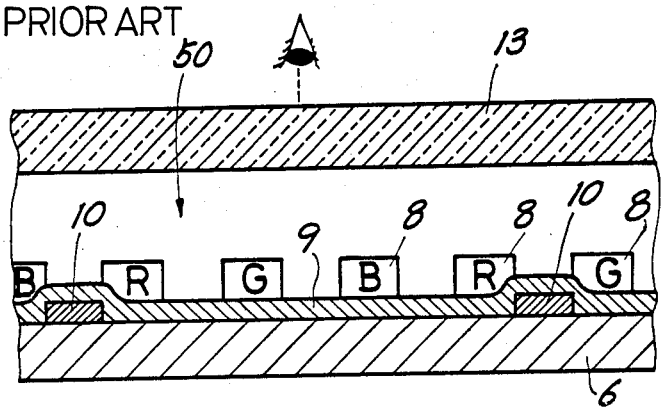
FIG. 8 PRIOR ART
FIG. 8 is a view in section taken along the line VIII—VIII in FIG. 7.
Figure 9:
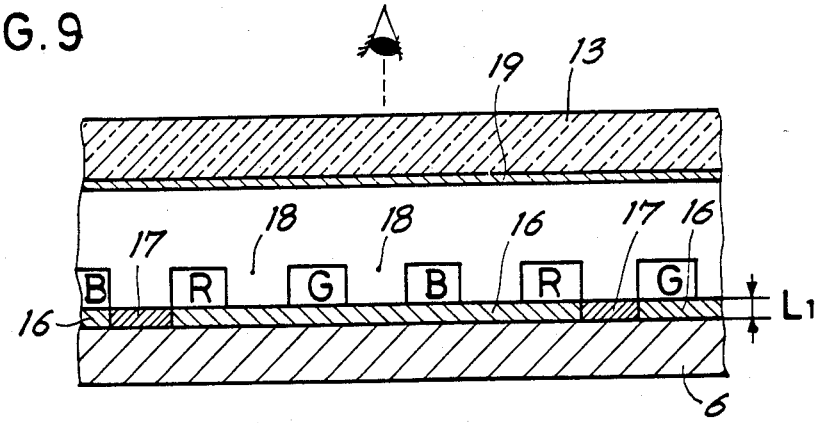
FIG. 9 is a sectional view of a color CRT we have already proposed.

FIG. 1 schematically shows a flat, color CRT of the present invention. Since the CRT is similar to the one shown in FIG. 6 in the construction of a flat glass tube 1 and in the arrangement of an electron gun 2, deflection yoke 14 and light collector plate 11, each of these parts is referred to by the same corresponding number. The CRT has a phosphor screen 20 which is characteristic of the invention and which therefore will be described below with reference to FIGS. 2 and 3, sectional views taken along the line II—II in FIG. 1, and with reference to FIG. 4 representing characteristics of the invention.

Figure 2:
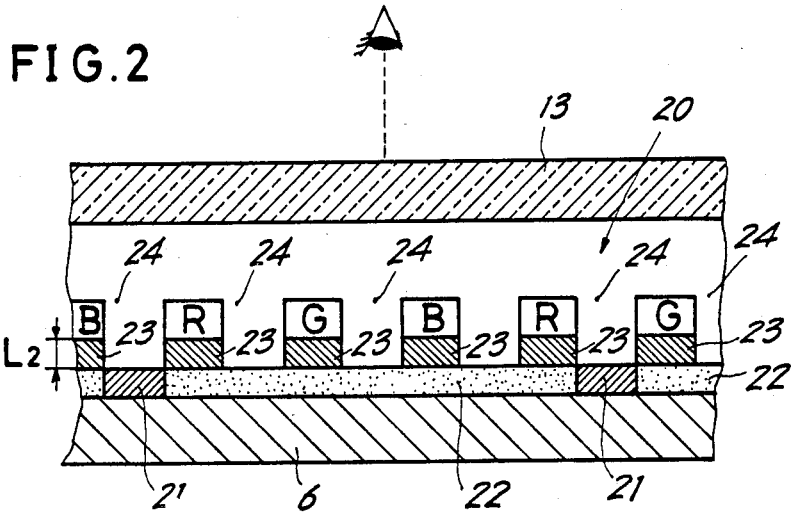
FIG. 2 is a view in cross section taken along the line II—II in FIG. 1 and showing an embodiment of the present invention.

FIG. 2 shows a first embodiment of the invention. Phosphor index stripes 21 are formed on the inner surface of a panel 6. On both sides of each phosphor index stripe 21, a black nonluminescent substance of a carbon coating composition 22 is coated over the remaining area of the panel inner surface except where the stripes 21 are formed. The undesirable substances, such as solvents, are removed from the coating when it is dried.

Next, aluminum is formed over the entire surface by vacuum evaporation to form a metallic layer 23. The metallic layer 23 is then coated with a photosensitive agent (resist). The coating is exposed to light for curing at the portions corresponding to the positions where primary phosphor color stripes R (red), G (green) and B (blue) are to be formed. The resist is thereafter treated with an aqueous acid solution, whereby the exposed uncured portions are removed, and the aluminum layer beneath the uncured resist portions are also etched away at the same time. Subsequently, the resist remaining on the metallic layer 23, thus formed in the shape of stripes, is removed by a chemical, and the phosphor color stripes R, G, B are formed on the metallic layer 23 in a repeating arrangement having a definite relation to the phosphor index stripes 21. In this way, the phosphor screen 20 is completed.

As in the prior art, the metallic layer 23 in contact with the phosphor color stripes R, G, B is set to a thickness $L_2$ which is sufficiently large so that when an electron beam excites the phosphor color stripes R, G, B, the resulting luminescence is totally reflected from the metallic layer 23 without passing therethrough. The luminance of the luminescent phosphor and the thickness of the metallic layer 23 generally have the relation shown in FIG. 4, although the relation varies with the level of the voltage for accelerating the electron beam, the condition of the glass surface to be coated with the metallic layer, the degree of deterioration of the metallic layer when the phosphor stripes are formed thereon, etc.

According to the preferred embodiment of the present invention, the metallic layer 23 has a thickness of at least about 3000 angstroms, more preferably 3000 to 4000 angstroms, to assure sufficient luminance of luminescence of the color phosphors R, G, B.

The present embodiment has the advantage that the stripes of the nonluminescent substance 22 have a large width and are therefore easy to form.

Figure 3:
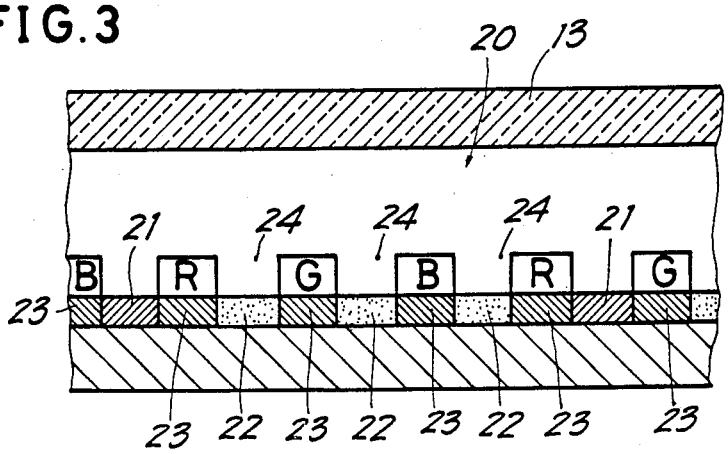
FIG. 3 is a view showing another embodiment.
Figure 4:
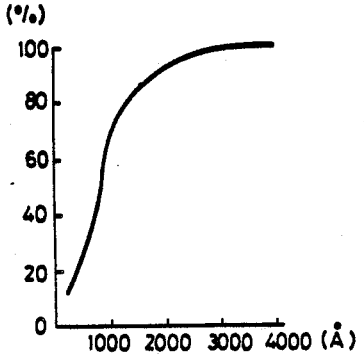
FIG. 4 is a diagram showing the relation between the thickness of metallic layer and the luminance of luminescence of a phosphor.
Figure 5:
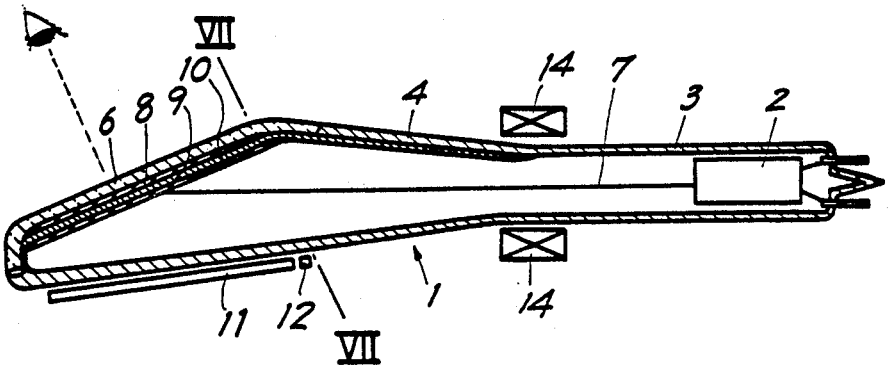
FIG. 5 PRIOR ART
FIG. 5 is a view in longitudinal section showing a conventional flat, color CRT.

FIG. 3 shows a second embodiment of the present invention. Throughout FIGS. 2 and 3, like parts are referred to by like numerals.

The second embodiment differs from the first in that a metallic layer 23 of sufficient thickness is formed directly on the inner surface of the panel 6 beneath the primary phosphor color stripes R, G, B without providing the layer 22 of nonluminescent substance therebetween. The metallic layer 23 can be adhered to the panel surface with improved stability without the likelihood of peeling off.

The color CRT of the present invention thus constructed has the outstanding advantages given below.

(i) The luminescence of the primary phosphor color stripes R, G, B produced by the electron beam 7 is totally reflected from the metallic layer 23 and directed toward the observation window 13, enabling the viewer to observe bright color images through the window 13.

(ii) With no metallic layer 23 formed over the phosphor index stripes 21, the electron beam excites the phosphor index stripe 21 without attenuation, affording index light of high intensity through the panel 6.

(iii) Because the black nonluminescent substance is provided in the spaces 24 between the phosphor color stripes other than the spaces where phosphor index stripes are formed, the image obtained has improved contrast.

While one phosphor index stripe is provided for every four phosphor color stripes according to the embodiments described, this arrangement is not limitative unless the index stripe is provided in every space between the color stripes.

The phosphor screen 20 thus fabricated may be protected with a thin $SiO_2$ film against ion scorching and further with a transparent conductive thin film of ITO (indium tin oxide) or the like formed over the $SiO_2$ film.

The foregoing disclosure and description of the invention are illustrative and explanatory thereof, and various changes in the size, shape and materials, as well as in the details of the illustrated construction may be made without departing from the spirit of the invention.

We claim:

1. A flat, color CRT comprising:

a flat glass tube having first and second walls opposed to each other;

an electron gun means for scanning the inner surface of said first wall with a single beam;

a phosphor screen provided on said first wall inner surface, said phosphor screen including phosphor index stripes provided on said first wall inner surface arranged at small spacings, non-luminescence substance provided on said first wall inner surface interposed continuously between said phosphor index strips strips of metallic layer formed on the upper surface of said non-luminescent substance arranged repeatedly at a small distance from one another in a definite relation to the phosphor index strips, and red, green and blue primary phosphor color strips being provided on each of said metallic layer strips; and an observation window provided in said second wall for observing the luminescence of said phosphor color strips of said phosphor screen.

2. A flat, color CRT as defined in claim 1 wherein the nonluminescent substance is black carbon.

3. A flat, color CRT as defined in claim 1 wherein the metallic layer is at least 3000 angstroms in thickness.

4. A flat, color CRT comprising:

a flat glass tube having first and second walls opposed to each other;

an electron gun for scanning the inner surface of said first wall with a single beam;

a phosphor screen provided on said first wall inner surface, said phosphor screen including phosphor index strips provided on said first wall inner surface arranged at small spacings, strips of metallic layer formed directly on said first wall inner surface arranged repeatedly at a small distance from one another in a definite relation to the phosphor index strips, a non-luminescence substance provided on said first wall inner surface between said strips of metallic layers, and red, green, and blue primary phosphor color strips formed on said metallic layer strips;

an observation window provided in said second wall for observing the luminescence of said phosphor color strips of said phosphor screen.

5. A flat, color CRT as defined in claim 4, wherein the nonluminescent substance is black carbon.

6. A flat, color CRT as defined in claim 4, wherein the metallic layer is at least 3000 angstroms in thickness.

* * * * *